US009985420B2

(12) United States Patent
Sekoguchi et al.

(10) Patent No.: US 9,985,420 B2
(45) Date of Patent: May 29, 2018

(54) DISCHARGE DEVICE

(71) Applicant: Sharp Kabushiki Kaisha, Osaka-shi, Osaka (JP)

(72) Inventors: Yoshinori Sekoguchi, Osaka (JP); Nobuyuki Ohe, Osaka (JP); Hiromu Nishida, Osaka (JP); Koichi Izu, Osaka (JP); Minako Taniguchi, Osaka (JP); Keitaro Yamada, Osaka (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 282 days.

(21) Appl. No.: 14/914,721

(22) PCT Filed: Sep. 17, 2014

(86) PCT No.: PCT/JP2014/074480
§ 371 (c)(1),
(2) Date: Feb. 26, 2016

(87) PCT Pub. No.: WO2015/141034
PCT Pub. Date: Sep. 24, 2015

(65) Prior Publication Data

US 2016/0211654 A1 Jul. 21, 2016

(30) Foreign Application Priority Data

Mar. 20, 2014 (JP) ..... 2014-058282

(51) Int. Cl.
*H01T 23/00* (2006.01)
*H01T 19/04* (2006.01)
(Continued)

(52) U.S. Cl.
CPC ..... *H01T 19/04* (2013.01); *B08B 3/04* (2013.01); *H01T 23/00* (2013.01); *B03C 3/38* (2013.01); *B03C 3/40* (2013.01); *B03C 2201/06* (2013.01)

(58) Field of Classification Search
USPC ..... 361/230, 232
See application file for complete search history.

(56) References Cited

U.S. PATENT DOCUMENTS

2010/0044246 A1* 2/2010 Hall ..... G01N 15/0656 205/775
2011/0115362 A1* 5/2011 Sekoguchi ..... B03C 3/383 313/230

FOREIGN PATENT DOCUMENTS

JP 61-32872 A 2/1986
JP 08-138830 A 5/1996
(Continued)

OTHER PUBLICATIONS

Official Communication issued in International Patent Application No. PCT/JP2014/074480, dated Oct. 21, 2014.

*Primary Examiner* — Danny Nguyen
(74) *Attorney, Agent, or Firm* — ScienBiziP, P.C.

(57) ABSTRACT

A discharge device capable of maintaining a stable discharge performance even in a highly humid environment or an atmospheric environment containing salt includes a discharge electrode discharging when a voltage is applied thereto, a substrate supporting the discharge electrode, an induction electrode arranged apart from the discharge electrode, and an insulator enclosing all of the substrate and the induction electrode. The discharge electrode has a root portion supported by the substrate, a pointed end protruding from a surface of the insulator, and a taper portion tapering from the root portion toward the pointed end. An outer
(Continued)

peripheral surface of the root portion is made of a material having an ionization tendency lower than that of hydrogen.

12 Claims, 6 Drawing Sheets

(51) Int. Cl.

| | |
|---|---|
| ***B08B 3/04*** | (2006.01) |
| *B03C 3/40* | (2006.01) |
| *B03C 3/38* | (2006.01) |

(56) References Cited

FOREIGN PATENT DOCUMENTS

| | | | |
|---|---|---|---|
| JP | 08-166708 | A | 6/1996 |
| JP | 08-298196 | A | 11/1996 |
| JP | 11-304761 | A | 11/1999 |
| JP | 2001-293363 | A | 10/2001 |
| JP | 2007-027074 | A | 2/2007 |
| JP | 2010-077462 | A | 4/2010 |
| JP | 2013-041681 | A | 2/2013 |
| JP | 2014-044888 | A | 3/2014 |
| WO | 2004/019462 | A1 | 3/2004 |

* cited by examiner

DISCHARGE DEVICE

TECHNICAL FIELD

The present invention relates to a discharge device, and particularly to a discharge device including a discharge electrode discharging when a voltage is applied thereto.

BACKGROUND ART

There are various apparatuses equipped with an ion generation device which utilizes a discharge phenomenon, and they are used in various environments. At present, discharge devices having a structure that a substrate to which a discharge electrode is fixed or a discharge electrode itself is fixed to a structural body such as resin and the periphery thereof is covered with an insulator are under development.

Currently, a metal needle is mainly adopted as an electrode used for the discharge phenomenon, and discharge electrodes made of SUS, tungsten, a nickel alloy, or the like are put to practical use. The surface of at least a body portion of a discharge electrode is plated with tin, nickel, or the like in order to solder the discharge electrode to a substrate. Corona discharge is generated at a tip of a metal needle to generate ions.

According to a device described in Japanese Patent Laying-Open No. 2010-77462 (PTD 1), a discharge electrode is made of a simple substance or an alloy of a transition metal such as gold, silver, or titanium, or a member plated with a transition metal, and particles of the transition metal are emitted to the outside to obtain an antibacterial effect.

Japanese Patent Laying-Open No. 2007-27074 (PTD 2) discloses a discharge electrode needle in which a needle-like electrode formed by plating a metal with gold is used to improve generation of corona discharge more effectively even at a low voltage, and thus negative ions and ozone can be generated in larger quantities.

CITATION LIST

Patent Document

PTD 1: Japanese Patent Laying-Open No. 2010-77462
PTD 2: Japanese Patent Laying-Open No. 2007-27074

SUMMARY OF INVENTION

Technical Problem

When discharge is performed using a discharge electrode including a metal as a member in a highly humid environment where condensation may occur or a severe environment such as seaside containing salt, a part of the metal used for the discharge electrode is eluted into the periphery thereof, although in a slight quantity. There is a concern that, due to this eluted component, a current flows through a portion other than a discharge portion, such as an electrode having a polarity opposite to that of the discharge electrode, or a case for a discharge device, and the original discharge performance in the discharge portion may be deteriorated.

The present invention has been made in view of the aforementioned problem, and a main object thereof is to provide a discharge device capable of maintaining a stable discharge performance over a long period of time even in a highly humid environment or an atmospheric environment containing salt.

Solution to Problem

A discharge device in accordance with a first aspect of the present invention includes a discharge electrode discharging when a voltage is applied thereto, a substrate supporting the discharge electrode, an induction electrode arranged apart from the discharge electrode, and an insulator enclosing all of the substrate and the induction electrode. The discharge electrode has a root portion supported by the substrate, a pointed end protruding from a surface of the insulator, and a taper portion tapering from the root portion toward the pointed end. An outer peripheral surface of the root portion is made of a material having an ionization tendency lower than that of hydrogen.

Preferably, the root portion is formed of the material having an ionization tendency lower than that of hydrogen.

Preferably, the root portion is plated with the material having an ionization tendency lower than that of hydrogen.

Preferably, the material having an ionization tendency lower than that of hydrogen is at least one metal selected from the group consisting of gold, palladium, platinum, and silver.

A discharge device in accordance with a second aspect of the present invention includes a discharge electrode discharging when a voltage is applied thereto, a substrate supporting the discharge electrode, an induction electrode arranged apart from the discharge electrode, and an insulator enclosing all of the substrate and the induction electrode. The discharge electrode has a root portion supported by the substrate, a pointed end protruding from a surface of the insulator, and a taper portion tapering from the root portion toward the pointed end. The discharge device further includes an insulation tube which is in close contact with an outer peripheral surface of the root portion.

Preferably, a surface of the insulation tube has water repellency.

Preferably, the discharge device further includes a sealing portion enclosing between the insulation tube and the insulator.

Preferably, a part of the insulation tube is embedded in the insulator.

A discharge device in accordance with a third aspect of the present invention includes a discharge electrode discharging when a voltage is applied thereto, a substrate supporting the discharge electrode, an induction electrode arranged apart from the discharge electrode, and an insulator enclosing all of the substrate and the induction electrode. The discharge electrode has a root portion supported by the substrate, a pointed end protruding from a surface of the insulator, and a taper portion tapering from the root portion toward the pointed end. The discharge device further includes a water-repellent coating layer covering an outer peripheral surface of the root portion.

Preferably, the water-repellent coating layer covers the insulator.

Preferably, the discharge device further includes a washing liquid supply portion supplying a washing liquid to a surface of the water-repellent coating layer.

Advantageous Effects of Invention

According to the discharge device of the present invention, elution of a metal component can be suppressed even in a highly humid environment or an atmospheric environment containing salt, and thus a stable discharge performance can be maintained over a long period of time.

DESCRIPTION OF EMBODIMENTS

Figure 1:
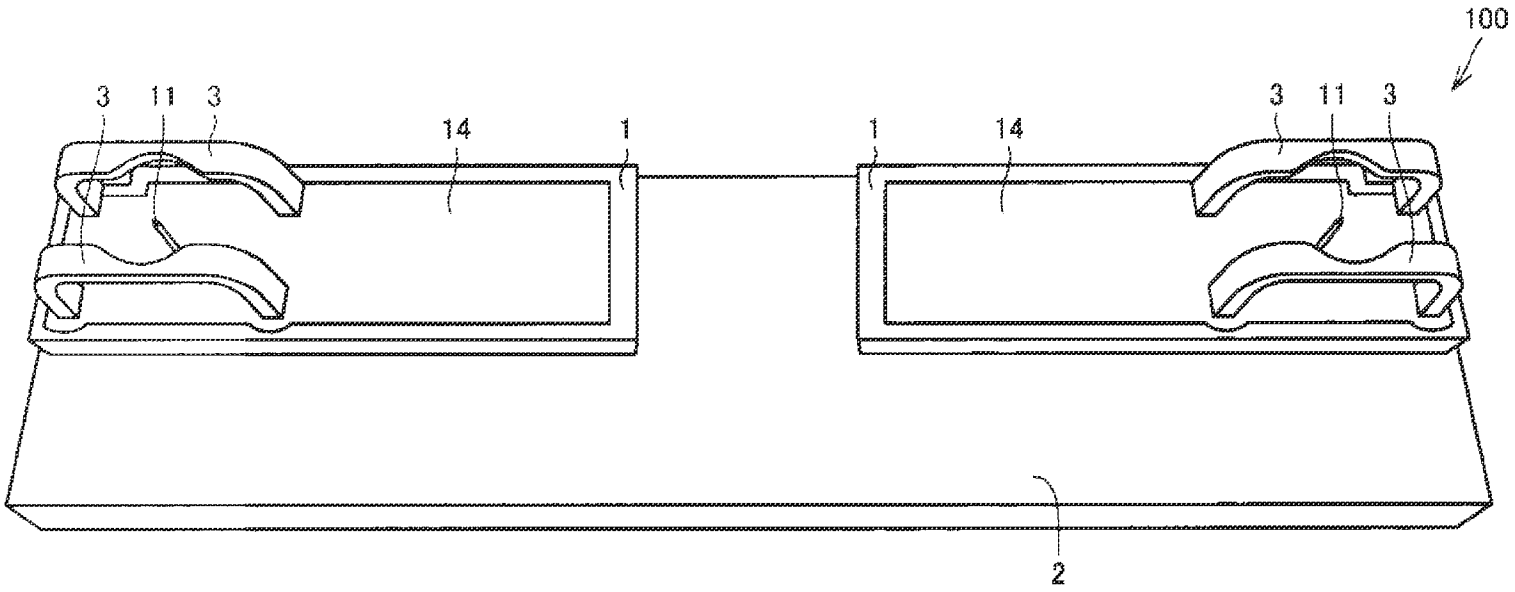
FIG. 1 is a perspective view showing a configuration of a discharge device of a first embodiment.

Hereinafter, embodiments of the present invention will be described with reference to the drawings. It is to be noted that, in the drawings below, identical or corresponding parts will be designated by the same reference numerals, and the description thereof will not be repeated.

First Embodiment

FIG. 1 is a perspective view showing a configuration of a discharge device 100 of a first embodiment. Referring to FIG. 1, discharge device 100 includes a plurality of discharge electrodes 11 and a main body case 2. Each discharge electrode 11 is formed in a needle-like shape. Main body case 2 is provided as a housing which gives the external appearance of discharge device 100. Main body case 2 has rectangular container portions 1. Each container portion 1 defines a bottomed hollow space therein. The internal space of container portion 1 is filled with an insulator 14 which is a resin material. Main body case 2 also has electrode protection walls 3 each arranged around discharge electrode 11. Each electrode protection wall 3 is provided to protect discharge electrode 11.

Figure 2:
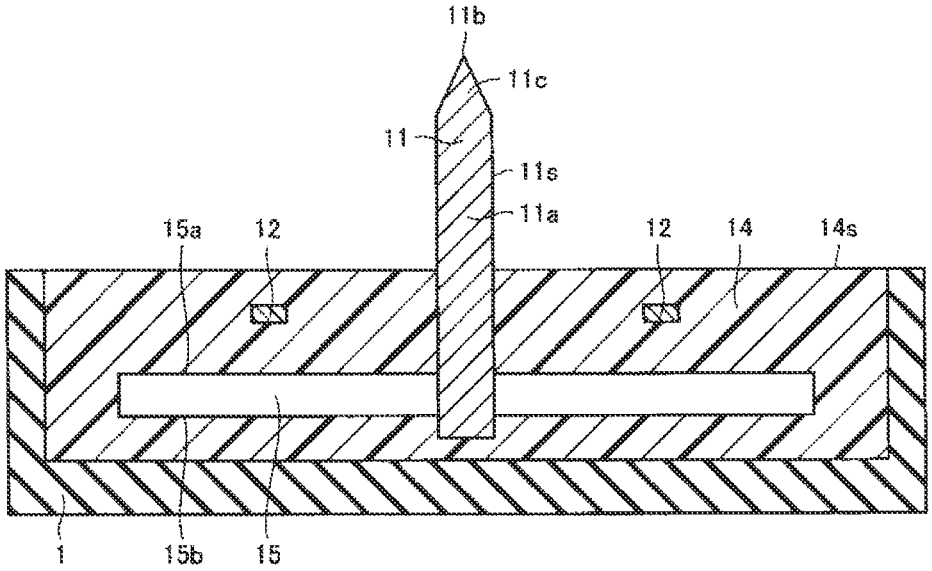
FIG. 2 is a cross sectional view showing the vicinity of a discharge electrode of the discharge device shown in FIG. 1.

FIG. 2 is a cross sectional view showing the vicinity of discharge electrode 11 of discharge device 100 shown in FIG. 1. Referring to FIG. 2, discharge electrode 11 has a root portion 11*a* supported by a substrate 15, a pointed end 11*b* having a sharp-pointed shape, and a taper portion 11*c* tapering from root portion 11*a* toward pointed end 11*b*. Root portion 11*a* has a base end of discharge electrode 11 opposite to pointed end 11*b*. A part of root portion 11*a* is embedded within insulator 14. A lower part of root portion 11*a* is sealed with insulator 14. Pointed end 11*b* protrudes from a surface 14*s* of insulator 14.

An induction electrode (counter electrode) 12 and substrate 15 are embedded within insulator 14. Discharge electrode 11 is supported by substrate 15. Induction electrode 12 is arranged around discharge electrode 11, at a position apart from discharge electrode 11. Induction electrode 12 serving as a reference potential is formed of a conductive material such as a metal. All of induction electrode 12 and substrate 15 are embedded within insulator 14 and enclosed by insulator 14.

As insulator 14, preferably, a thermosetting resin such as an epoxy resin, or a coating material prepared by dissolving a rubber-based polymer material in a solvent is charged. Preferably, insulator 14 has a thickness enough to fully enclose induction electrode 12 and substrate 15.

Substrate 15 has a plate-like shape, and is arranged parallel to a bottom surface of container portion 1 of main body case 2. Substrate 15 has a main surface 15*a* constituting a discharge-side surface, and a back surface 15*b* opposite to main surface 15*a*. Main surface 15*a* and back surface 15*b* of substrate 15 are covered with insulator 14. A through hole penetrating substrate 15 in a thickness direction and extending from main surface 15*a* to back surface 15*b* is formed in substrate 15. The through hole formed in substrate 15 may be a through hole via having a conductor formed on an inner wall surface thereof.

Discharge electrode 11 is inserted in the through hole formed in substrate 15. Root portion 11*a* of discharge electrode 11 is fixed to substrate 15, for example by soldering, and thereby discharge electrode 11 is supported by substrate 15. The other end of discharge electrode 11 opposite to pointed end 11*b* protrudes from back surface 15*b* of substrate 15. Discharge electrode 11 is supported by substrate 15 in a state where it penetrates substrate 15. Wiring patterns are formed on main surface 15*a* and back surface 15*b* of substrate 15. Discharge electrode 11 is electrically connected to the wiring patterns formed on substrate 15 or lead wires, by soldering.

Although the example shown in FIG. 2 illustrates discharge electrode 11 in the state where it penetrates substrate 15, discharge electrode 11 may be provided in a state where it is mounted on main surface 15*a* of substrate 15.

Discharge device 100 applies a high voltage to discharge electrode 11 to produce a potential difference between discharge electrode 11 and induction electrode 12, and thereby generates corona discharge from pointed end 11*b* of discharge electrode 11 to generate ions. Discharge device 100 is configured such that pointed end 11*b* of discharge electrode 11 protrudes from surface 14*s* of insulator 14, and thereby ions generated at pointed end 11*b* can be immediately transported.

If a circuit for generating the high voltage to be applied to discharge electrode 11 is present within main body case 2 of the discharge device, the circuit is desirably covered with main body case 2 or enclosed by insulator 14. This can prevent the circuit for generating the high voltage from being exposed to a severe environment, and can suppress occurrence of a leak at a location other than an electrode portion. Further, a voltage may be applied to discharge electrode 11 via substrate 15.

Further, the high voltage to be applied to discharge electrode 11 may be supplied from the outside of discharge device 100. In that case, it is desirable to enclose a path such as a substrate and a connector for supplying the high voltage to discharge electrode 11, by an insulator, a water-resistant gel, an insulation tube, or the like. This can prevent the periphery of the path from being exposed to a severe environment, and can suppress occurrence of a leak at a location other than the electrode portion.

Although the high voltage to be applied to discharge electrode 11 is basically a pulsed voltage, it may be a direct current voltage. Further, the voltage may have any magnitude, as long as discharge occurs.

When discharge device 100 includes the plurality of discharge electrodes 11 as shown in FIG. 1, it is desirable to apply a positive voltage to one discharge electrode 11 and apply a negative voltage to the other discharge electrode 11 to generate both positive ions and negative ions at the same time. Further, a positive voltage and a negative voltage may be alternately applied to one discharge electrode 11 to generate both positive ions and negative ions from the one discharge electrode 11.

Although induction electrode 12 is located at two positions to the right and left of discharge electrode 11 in the example shown in FIG. 2, any shape and arrangement thereof may be adopted as long as it serves as a potential reference. Further, induction electrode 12 may be a metal body such as a metal plate or a wire, or a pattern printed on substrate 15, and induction electrode 12 may be made of any material as long as it serves as a potential reference.

Although discharge electrode 11 has a needle-like shape in the present example, it may be a fine wire or an extra fine wire. Further, discharge electrode 11 may have a shape of a thin plate with a pointed tip, as long as discharge electrode 11 can discharge.

Discharge electrode 11 is formed of a conductive material such as a metal. At least an outer peripheral surface 11*s* of root portion 11*a* of discharge electrode 11 is made of a material having an ionization tendency lower than that of hydrogen. Root portion 11*a* of discharge electrode 11 may be formed of the material having an ionization tendency lower than that of hydrogen. Entire discharge electrode 11 may be formed of the material having an ionization tendency lower than that of hydrogen. Alternatively, outer peripheral surface 11*s* of root portion 11*a* of discharge electrode 11 or an outer peripheral surface of entire discharge electrode 11 may be plated with the material having an ionization tendency lower than that of hydrogen. The material having an ionization tendency lower than that of hydrogen may be at least one metal selected from the group consisting of gold, palladium, platinum, and silver.

According to discharge device 100 of the first embodiment described above, outer peripheral surface 11*s* of root portion 11*a* of discharge electrode 11 is made of the material having an ionization tendency lower than that of hydrogen constituting water. Since the metal constituting outer peripheral surface 11*s* of root portion 11*a* of discharge electrode 11 has a property that it is less ionized when compared with water, the metal is less likely to be eluted into water. Accordingly, elution of a metal component constituting discharge electrode 11 can be suppressed.

In addition, all of substrate 15 supporting discharge electrode 11 and induction electrode 12 having a polarity opposite to that of discharge electrode 11 are enclosed by insulator 14. Accordingly, even if the metal material constituting discharge electrode 11 is eluted, adhesion of an eluted component to substrate 15 or induction electrode 12 can be suppressed. Therefore, occurrence of a leak can be suppressed even in the case where the component of discharge electrode 11 is eluted, and thus the discharge performance of discharge device 100 can be maintained stably for a long period of time even in a highly humid environment or an atmospheric environment containing salt.

Second Embodiment

Figure 3:
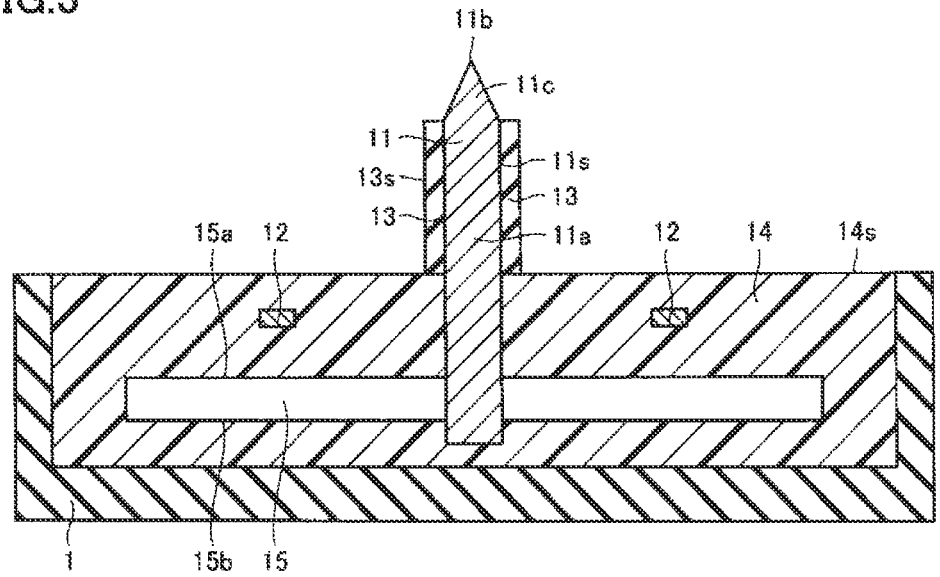
FIG. 3 is a cross sectional view of a discharge device of a second embodiment.

FIG. 3 is a cross sectional view of discharge device 100 of a second embodiment. Discharge device 100 of the second embodiment basically has the same configuration as that of discharge device 100 of the first embodiment described above. However, discharge device 100 of the second embodiment is different from that of the first embodiment in that it further includes an insulation tube 13 which is in close contact with outer peripheral surface 11*s* of root portion 11*a* of discharge electrode 11.

Insulation tube 13 holds insulation properties, covers root portion 11*a* of discharge electrode 11, and has an inner diameter which allows insulation tube 13 to come into close contact with discharge electrode 11 as much as possible. Insulation tube 13 may be a heat shrinkable tube, for example. By selecting heat shrinkable insulation tube 13 which shrinks to be narrower than the outer diameter of root portion 11*a* of discharge electrode 11, and fully applying heat to insulation tube 13, insulation tube 13 can be brought into close contact with outer peripheral surface 11*s* of discharge electrode 11. Alternatively, insulation tube 13 may be an elastically deformable tube having an inner diameter smaller than the outer diameter of root portion 11*a* of discharge electrode 11.

Although insulation tube 13 preferably has a length covering entire root portion 11*a* of discharge electrode 11, a part of outer peripheral surface 11*s* of root portion 11*a* on the pointed end 11*b* side may be exposed. On the other hand, insulation tube 13 desirably has such a length that does not allow insulation tube 13 to cover the periphery of taper portion 11*c* of discharge electrode 11. This is because, if a gap is formed between an outer peripheral surface of taper portion 11*c* and insulation tube 13, moisture accumulates in the gap and the metal component of discharge electrode 11 is likely to be eluted thereinto. That is, it is desirable that the length of root portion 11*a* protruding from surface 14*s* of insulator 14 is greater than the length of insulation tube 13 protruding from surface 14*s* of insulator 14.

Although insulation tube 13 may have any thickness, insulation tube 13 preferably has such a thickness that does not affect the positional relation between needle-shaped discharge electrode 11 and induction electrode 12.

Preferably, a surface 13*s* of insulation tube 13 is formed of a material having water repellency. Surface 13*s* of insulation tube 13 may be formed of, for example, polyolefin, a fluorine-based polymer, a thermoplastic elastomer, PTFE (tetrafluoroethylene resin), or the like. Alternatively, surface 13*s* of insulation tube 13 may be treated with a fluorine-containing coating agent or the like.

According to discharge device 100 of the second embodiment described above, since insulation tube 13 is brought into close contact with discharge electrode 11, outer peripheral surface 11*s* of root portion 11*a* of discharge electrode 11 can be prevented from being directly exposed to an ambient environment. Accordingly, elution of a metal component constituting discharge electrode 11 can be suppressed even in a highly humid environment or an atmospheric environment containing salt.

In addition, insulation tube 13 has a function that, even if the metal material constituting discharge electrode 11 is eluted, insulation tube 13 keeps an eluted component therein and suppresses adhesion of the eluted component to substrate 15 or induction electrode 12. Therefore, occurrence of a leak can be suppressed even in the case where the component of discharge electrode 11 is eluted, and thus the discharge performance of discharge device 100 can be maintained stably for a long period of time.

Third Embodiment

Figure 4:
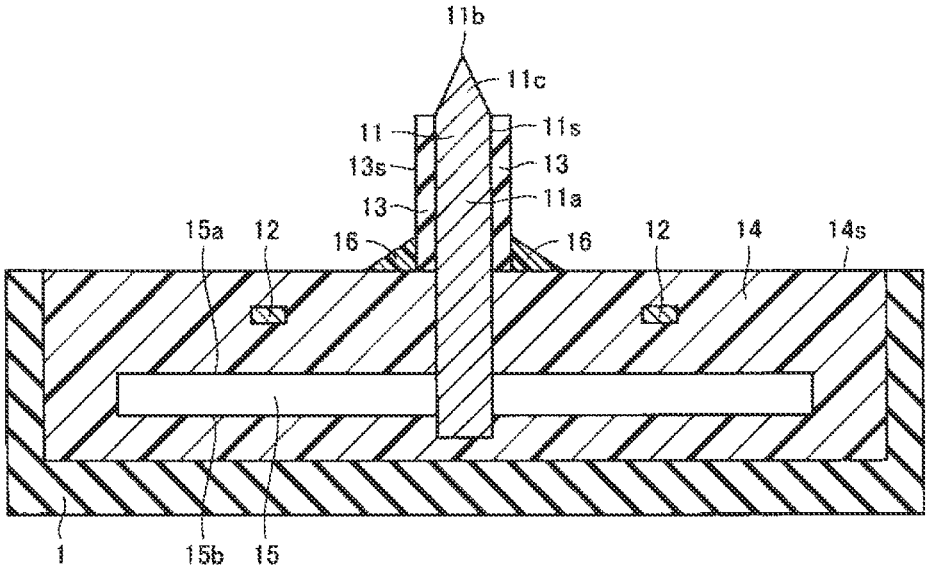
FIG. 4 is a cross sectional view of a discharge device of a third embodiment.

FIG. 4 is a cross sectional view of discharge device 100 of a third embodiment. Discharge device 100 of the third embodiment is different from that of the second embodiment in that it further includes a sealing portion 16 enclosing between insulation tube 13 and surface 14*s* of insulator 14.

In the present embodiment, the root of insulation tube 13 is sealed with insulating sealing portion 16 to enclose between insulator 14 and insulation tube 13. This can prevent formation of a gap between discharge electrode 11 and insulation tube 13, and can prevent outer peripheral surface 11*s* of root portion 11*a* of discharge electrode 11 from being directly exposed to an ambient environment. Further, even in the case where the component of discharge electrode 11 is eluted, the eluted component can be prevented from flowing out of insulation tube 13, and can be prevented from leaking to the electrode having an opposite polarity or main body case 2.

Sealing portion 16 may be a member integrated with or separate from insulator 14. Specifically, sealing portion 16 may be formed by applying an insulating adhesive to the root of discharge electrode 11 to have a sufficient thickness.

Preferably, sealing portion 16 is adjacent to and brought into close contact with both insulation tube 13 and insulator 14. This can prevent outer peripheral surface 11*s* of root portion 11*a* of discharge electrode 11 from being directly exposed to an ambient environment. Further, this can prevent outflow of the eluted component of discharge electrode 11 more reliably.

Fourth Embodiment

Figure 5:
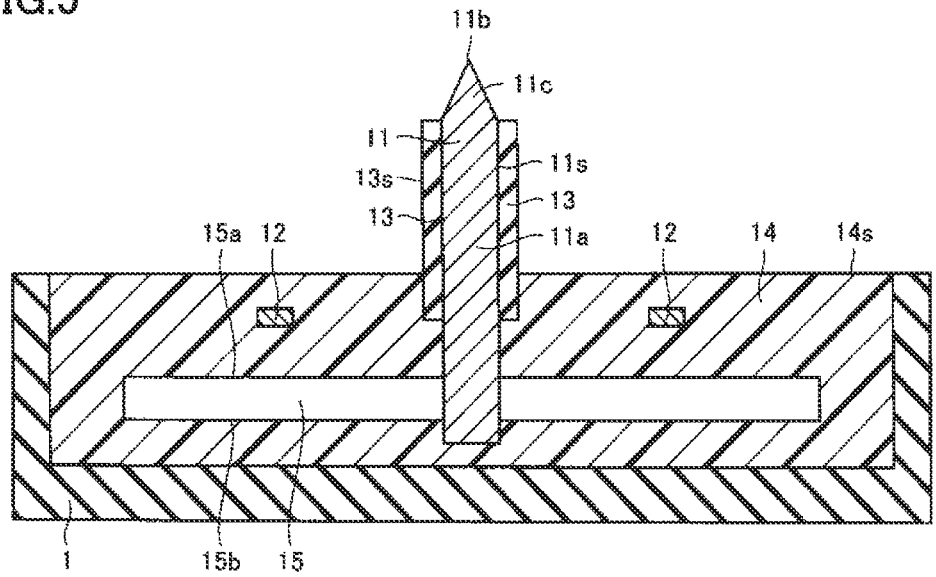
FIG. 5 is a cross sectional view of a discharge device of a fourth embodiment.

FIG. 5 is a cross sectional view of discharge device 100 of a fourth embodiment. In discharge device 100 of the fourth embodiment, a part of insulation tube 13 is embedded within insulator 14. This can enclose the root of insulation tube 13 without using sealing portion 16 described in the third embodiment, and can reliably prevent outer peripheral surface 11*s* of root portion 11*a* of discharge electrode 11 from being directly exposed to an ambient environment. Further, this can prevent outflow of the eluted component of discharge electrode 11 to the outside.

In the present embodiment, insulator 14 preferably has a property that it hardens with a lapse of time, or thermosetting property. In that case, discharge device 100 of the present embodiment can be produced by attaching insulation tube 13 to discharge electrode 11 and embedding them in insulator 14 after insulator 14 is charged within container portion 1 and before insulator 14 hardens, and thereafter hardening insulator 14.

Fifth Embodiment

Figure 6:
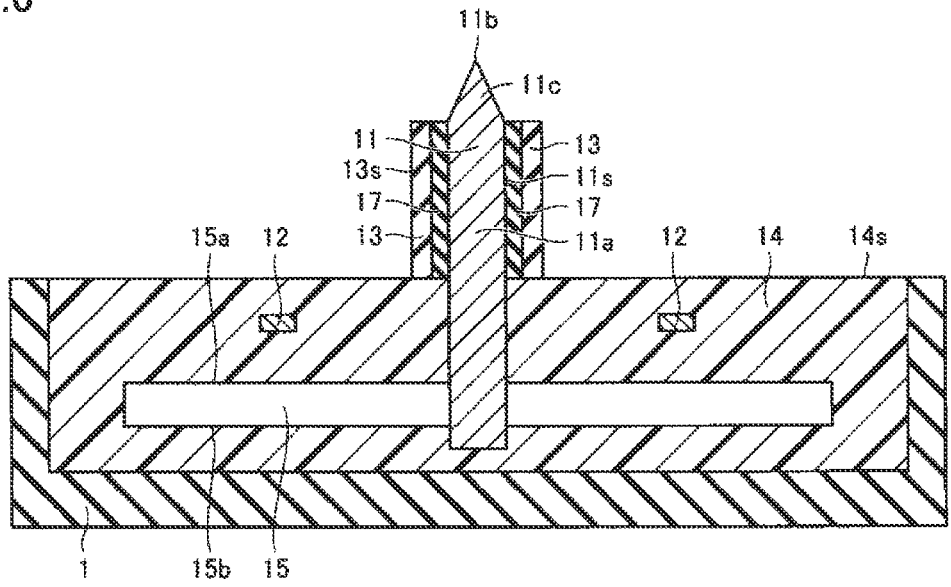
FIG. 6 is a cross sectional view of a discharge device of a fifth embodiment.

FIG. 6 is a cross sectional view of discharge device 100 of a fifth embodiment. In discharge device 100 of the fifth embodiment, an insulator 17 as another insulator is provided between discharge electrode 11 and insulation tube 13, and discharge electrode 11 and insulation tube 13 are brought into close contact with each other with insulator 17 being interposed therebetween. This can further narrow the gap between discharge electrode 11 and insulation tube 13, and can further prevent discharge electrode 11 from being exposed to a severe environment.

Insulator 17 may be made of material identical to or different from insulator 14. Since insulator 17 should be charged to fill the gap between discharge electrode 11 and insulation tube 13, insulator 17 is preferably in the form of a liquid when it is charged, and has a property that it hardens with a lapse of time, or thermosetting property.

When insulator 17 is charged between discharge electrode 11 and insulation tube 13, it may be charged by a method with which it is charged from above so as not to allow entrance of air bubbles, or a method with which it is soaked up from the root utilizing a capillary phenomenon.

Preferably, insulator 17 is charged up to the same height as that of insulation tube 13 as much as possible. As long as insulator 17 has a height equal to or more than that of insulation tube 13, insulator 17 may protrude from insulation tube 13. This can fill the gap between discharge electrode 11 and insulation tube 13.

Although the root of insulation tube 13 is placed on surface 14*s* of insulator 14 in FIG. 6, the root of the insulation tube 13 may be sealed with sealing portion 16 as described in the third embodiment, or a part of insulation tube 13 may be embedded in insulator 14 as in the fourth embodiment.

Sixth Embodiment

Figure 7:
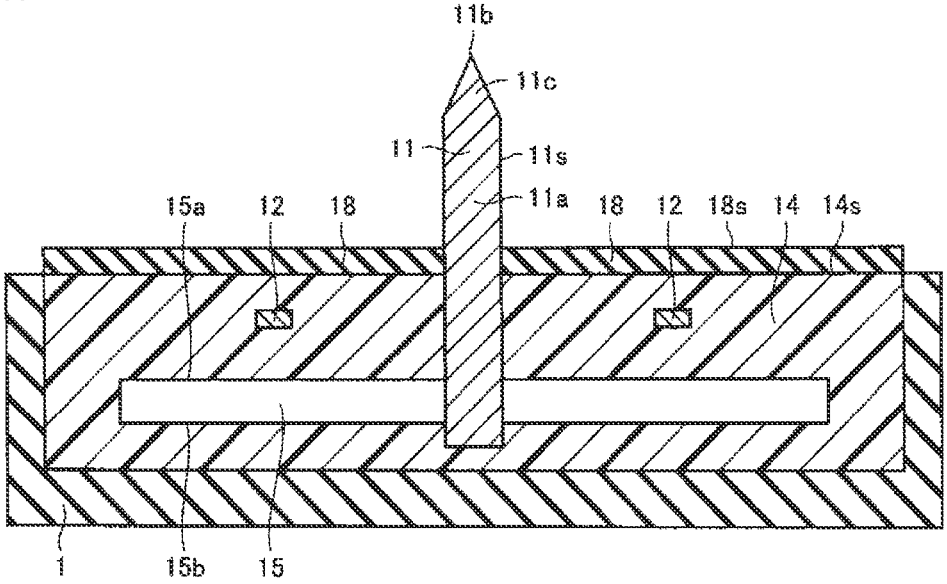
FIG. 7 is a cross sectional view of a discharge device of a sixth embodiment.

FIG. 7 is a cross sectional view of discharge device 100 of a sixth embodiment. Discharge device 100 of the sixth embodiment is different from that of the first embodiment in that it further includes a water-repellent coating layer 18 covering surface 14*s* of insulator 14.

A surface 18*s* of water-repellent coating layer 18 has water repellency. Here, water repellency is represented by an angle at which the surface of a solid material is in contact with water droplets (contact angle), and when the surface has a contact angle with water droplets of greater than 90°, the surface has water repellency. Water-repellent coating layer 18 is formed by being treated such that surface 18*s* of water-repellent coating layer 18 has a contact angle with water droplets of greater than 90°.

By providing water-repellent coating layer 18 covering surface 14*s* of insulator 14, even in the case where the component of discharge electrode 11 is eluted, water droplets containing the eluted component are present on water-repellent coating layer 18. When a user who uses discharge device 100 performs cleaning, the user can easily remove the eluted component of discharge electrode 11 from above water-repellent coating layer 18. Therefore, even in the case where the component of discharge electrode 11 is eluted, accumulation of the eluted component can be prevented and occurrence of a leak can be suppressed, and thus the discharge performance of discharge device 100 can be maintained stably for a long period of time.

Seventh Embodiment

Figure 8:
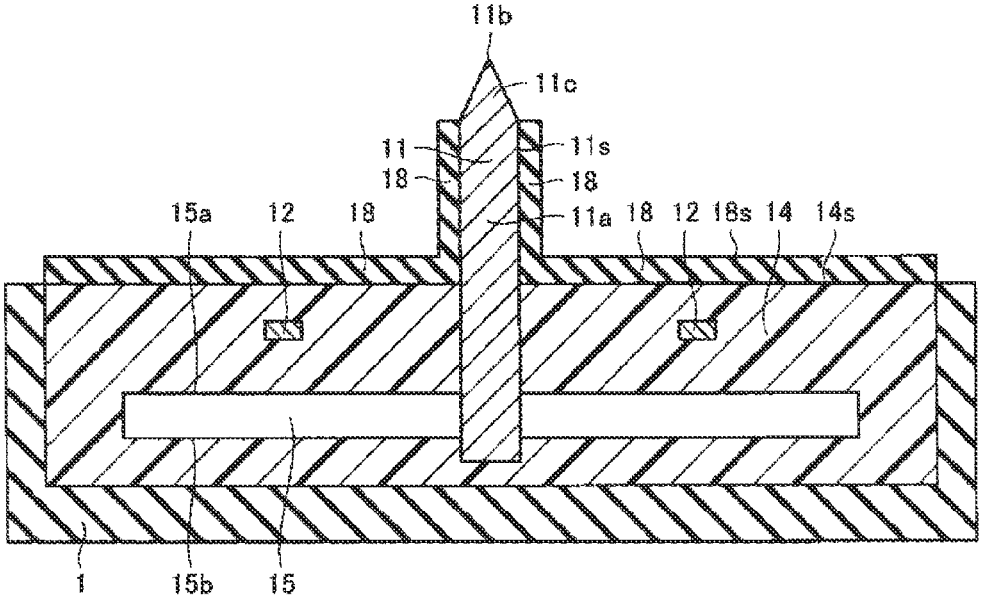
FIG. 8 is a cross sectional view of a discharge device of a seventh embodiment.

FIG. 8 is a cross sectional view of discharge device 100 of a seventh embodiment. In discharge device 100 of the seventh embodiment, water-repellent coating layer 18 covers not only surface 14*s* of insulator 14 but also outer peripheral surface 11*s* of root portion 11*a* of discharge electrode 11.

By providing water-repellent coating layer 18 covering outer peripheral surface 11*s* of root portion 11*a* of discharge electrode 11, even if water droplets containing salt sticks to water-repellent coating layer 18 around discharge electrode 11, the water droplets immediately move away from discharge electrode 11 due to water repellency. Since contact of moisture with discharge electrode 11 can be suppressed, elution of the metal constituting discharge electrode 11 into water can be suppressed. Therefore, the discharge performance of discharge device 100 can be maintained stably for a long period of time even in a highly humid environment or an atmospheric environment containing salt.

Eighth Embodiment

Figure 9:
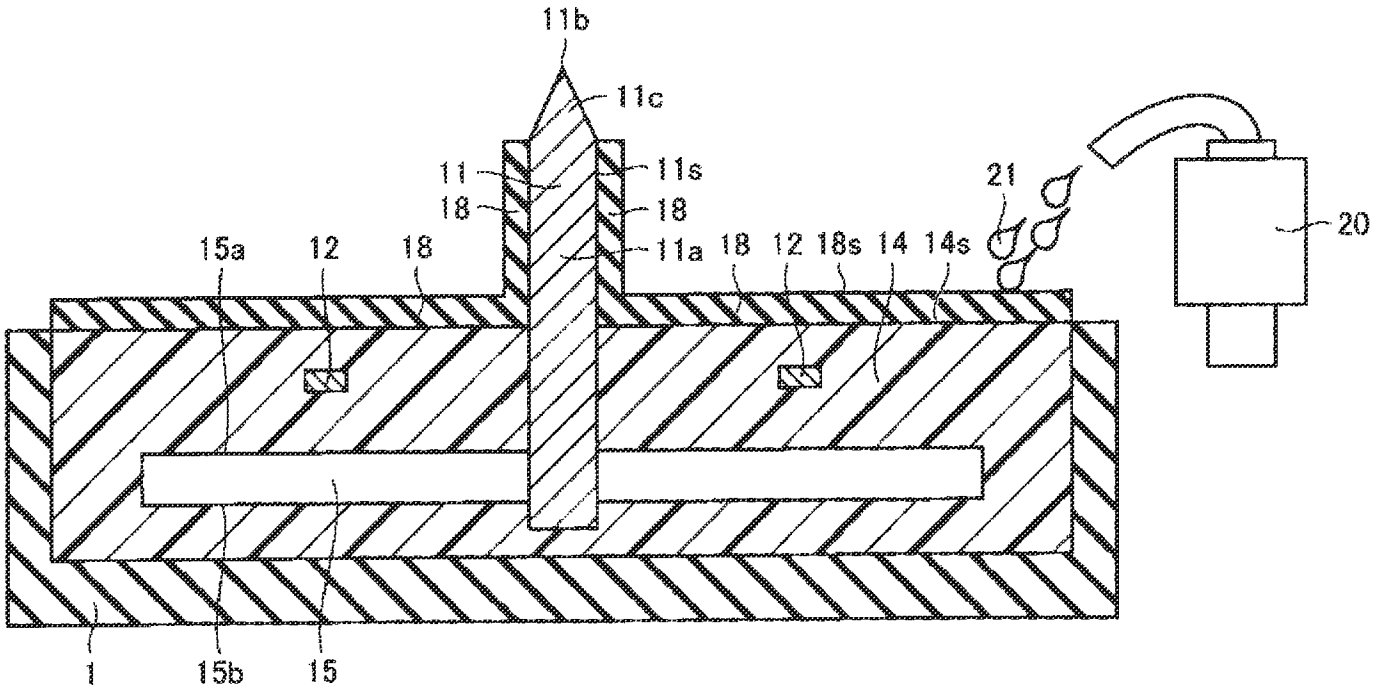
FIG. 9 is a cross sectional view of a discharge device of an eighth embodiment.

FIG. 9 is a cross sectional view of discharge device 100 of an eighth embodiment. Discharge device 100 of the eighth embodiment is different from that of the first embodiment in that it further includes a washing liquid supply portion 20 supplying a washing liquid 21 to surface 18*s* of water-repellent coating layer 18. Washing liquid 21 may be washing water or another liquid, and washing liquid supply portion 20 may be a pump.

By spraying washing liquid 21 onto surface 18*s* of water-repellent coating layer 18 using washing liquid supply portion 20, matter sticking to surface 18*s* can be easily washed away. Since cleaning of surface 18*s* of water-repellent coating layer 18 can be automated, the eluted component of discharge electrode 11 can be easily removed from above water-repellent coating layer 18 without imposing a burden of cleaning on the user who uses discharge device 100. Therefore, even in the case where the component of discharge electrode 11 is eluted, accumulation of the eluted component can be prevented and occurrence of a leak can be suppressed, and thus the discharge performance of discharge device 100 can be maintained stably for a long period of time.

In discharge device 100 of each of the second to eighth embodiments, even in the case where the metal component of discharge electrode 11 is eluted, outflow of the eluted component can be prevented by insulation tube 13, or accumulation of the eluted component can be prevented due to water-repellent coating layer 18. Accordingly, there is no need to use discharge electrode 11 of the first embodiment whose outer peripheral surface 11*s* is formed of a material having an ionization tendency lower than that of hydrogen. Since there is no need to use a precious metal as a material for discharge electrode 11, less expensive discharge electrode 11 can be used.

Although the embodiments of the present invention have been described above, the configurations of these embodiments may be combined as appropriate. Further, it should be understood that the embodiments disclosed herein are illustrative and non-restrictive in every respect. The scope of the present invention is defined by the scope of the claims, rather than the description above, and is intended to include any modifications within the scope and meaning equivalent to the scope of the claims.

INDUSTRIAL APPLICABILITY

The present invention is widely applicable to various devices including a discharge device, such as an ion generation device, an ozone generation device, and a static elimination device.

REFERENCE SIGNS LIST

1: container portion; 2: main body case; 3: electrode protection wall; 11: discharge electrode; 11*a*: root portion; 11*b*: pointed end; 11*c*: taper portion; 11*s*: outer peripheral surface; 12: induction electrode; 13: insulation tube; 13*s*, 14*s*, 18*s*: surface; 14, 17: insulator; 15: substrate; 15*a*: main surface; 15*b*: back surface; 16: sealing portion; 18: water-repellent coating layer; 20: washing liquid supply portion; 21: washing liquid; 100: discharge device.

The invention claimed is:

1. A discharge device, comprising:

a discharge electrode discharging when a voltage is applied thereto;

a substrate supporting the discharge electrode;

an induction electrode arranged apart from the discharge electrode; and an insulator enclosing all of the substrate and the induction electrode, wherein the discharge electrode has a root portion supported by the substrate, a pointed end protruding from a surface of the insulator, and a taper portion tapering from the root portion toward the pointed end, and an outer peripheral surface of the root portion is made of a material having an ionization tendency lower than that of hydrogen.

2. The discharge device according to claim 1, wherein the root portion is formed of the material having an ionization tendency lower than that of hydrogen.

3. The discharge device according to claim 1, wherein the root portion is plated with the material having an ionization tendency lower than that of hydrogen.

4. The discharge device according to claim 1, wherein the material having an ionization tendency lower than that of hydrogen is at least one metal selected from the group consisting of gold, palladium, platinum, and silver.

5. A discharge device, comprising:

a discharge electrode discharging when a voltage is applied thereto;

a substrate supporting the discharge electrode;

an induction electrode arranged apart from the discharge electrode; and an insulator enclosing all of the substrate and the induction electrode, wherein the discharge electrode has a root portion supported by the substrate, a pointed end protruding from a surface of the insulator, and a taper portion tapering from the root portion toward the pointed end, and the discharge device further comprises an insulation tube which is in close contact with an outer peripheral surface of the root portion.

6. The discharge device according to claim 5, wherein a surface of the insulation tube has water repellency.

7. The discharge device according to claim 5, further comprising a sealing portion enclosing between the insulation tube and the insulator.

8. The discharge device according to claim 5, wherein a part of the insulation tube is embedded in the insulator.

9. The discharge device according to claim 5, wherein another insulator is provided between the discharge electrode and the insulation tube, and the discharge electrode and the insulation tube are brought into close contact with each other with the other insulator being interposed therebetween.

10. A discharge device, comprising:

a discharge electrode discharging when a voltage is applied thereto;

a substrate supporting the discharge electrode;

an induction electrode arranged apart from the discharge electrode; and an insulator enclosing all of the substrate and the induction electrode, wherein the discharge electrode has a root portion supported by the substrate, a pointed end protruding from a surface of the insulator, and a taper portion tapering from the root portion toward the pointed end, and the discharge device further comprises a water-repellent coating layer covering an outer peripheral surface of the root portion.

11. The discharge device according to claim 10, wherein the water-repellent coating layer covers the insulator.

12. The discharge device according to claim 11, further comprising a washing liquid supply portion supplying a washing liquid to a surface of the water-repellent coating layer.

* * * * *